US010339737B1

(12) United States Patent
Santhosh et al.

(10) Patent No.: US 10,339,737 B1
(45) Date of Patent: Jul. 2, 2019

(54) AUTOMATED ATTENDEE MONITORING AND GUIDANCE SYSTEM

(71) Applicant: Carrier Corporation, Jupiter, FL (US)

(72) Inventors: Amuduri Santhosh, Jupiter, FL (US); Ramesh Lingala, Jupiter, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 0 days.

(21) Appl. No.: 15/864,262

(22) Filed: Jan. 8, 2018

(30) Foreign Application Priority Data

Dec. 8, 2017 (IN) ..... 201711044105

(51) Int. Cl.
*G07C 9/00* (2006.01)
*G06Q 90/00* (2006.01)

(52) U.S. Cl.
CPC ..... *G07C 9/00103* (2013.01); *G07C 9/00111* (2013.01); *G07C 9/00119* (2013.01); *G06Q 90/20* (2013.01)

(58) Field of Classification Search
CPC ..... G07C 9/00111; G07C 9/00309; G07C 2009/00793; G07C 9/00103; G07C 9/00571; G07C 9/00182; G07C 2009/00634
USPC ..... 340/5.7
See application file for complete search history.

(56) References Cited

U.S. PATENT DOCUMENTS 8,768,294 B2 * 7/2014 Reitnour ..... H04W 4/90 455/404.2
8,874,024 B2 10/2014 Argott
9,204,257 B1 12/2015 Mendelson
9,219,980 B2 * 12/2015 Moldavsky ..... H04W 4/02
9,432,808 B1 8/2016 Reyes et al.
9,532,183 B2 * 12/2016 Roth ..... H04W 4/04
9,715,807 B2 * 7/2017 Howard ..... G08B 21/0272
9,715,833 B2 * 7/2017 Jabara ..... G09B 5/00
9,723,035 B1 * 8/2017 Siddiqui ..... H04L 65/403
9,734,643 B2 * 8/2017 Hanson ..... G07C 9/00039
9,753,117 B2 * 9/2017 Snapp ..... G01S 5/0231
(Continued)

OTHER PUBLICATIONS

INQ-ADMIN, Beacons for Education, Inquirly, Mar. 26, 2016, retrieved from https://web.archive.org/web/20160404042324/http://inquirly.com:80/beacons-education/.
(Continued)

*Primary Examiner* — Mark S Blouin
(74) *Attorney, Agent, or Firm* — Carlson, Gaskey & Olds, P.C.

(57) ABSTRACT

A method for monitoring a location of a group of individuals includes receiving a first signal and at least one beacon ID corresponding to a unique beacon from a set of beacons at a server. The first signal includes an individual identification (ID) corresponding to a specific individual. The method then Cross-checks the individual ID and the at least one beacon ID with an allowed individuals list, and unlocks an entry-way corresponding to a unique beacon ID in the at least one beacon ID in response to the unique beacon ID corresponding to an entry-way beacon at a room which the individual ID is authorized to access, and cross-checks the individual ID and the at least one beacon ID with an attendance list, and updates an attendance monitoring file on said server in response to the unique beacon ID in the at least one beacon ID corresponding to an interior room beacon.

19 Claims, 4 Drawing Sheets

(56) References Cited

U.S. PATENT DOCUMENTS

| | | | |
|---|---|---|---|
| 2015/0296347 | A1 | 10/2015 | Roth |
| 2016/0037333 | A1 | 2/2016 | Amundsen et al. |
| 2016/0293025 | A1 | 10/2016 | Marr et al. |
| 2016/0364819 | A1 | 12/2016 | Salimi et al. |
| 2016/0381210 | A1 | 12/2016 | Kenjalkar et al. |

OTHER PUBLICATIONS

Schuerman, Morgan, 7 Reasons to Use Beacon Technology on Campuses, eLearning Industry—Educational Technology, Jan. 25, 2016, retrieved from https://elearningindustry.com/5-authoring-technology-issues-limit-ability-scale on Jan. 8, 2018.

Paek, Jeongyeup, Jeonggil Ko, and Hyungsik Shin, A Measurement Study of BLE iBeacon and Geometric Adjustment Scheme for Indoor Location-Based Mobile Applications, Hindawi Publishing Corporation, Mobile Information Systems, vol. 2016, pp. 1-13, Aug. 12, 2016.

Kumar, Jay, Amit Kumar, Achint Kumar Choubey, and Abhinav Singh, Automatic Attendance Monitoring and Tracking System Using Bluetooth and Face Identification, International Journal of Advanced Research in Electronics and Communication Engineering, vol. 5, Issue 4, pp. 1166-1170, Apr. 2016.

Deugo, D., Using Beacons for Attendance Tracking, International Conference Frontiers in Education: CS and CE—FECS'16, pp. 155-161, CSREA Press.

Callahan, Sean, 3 Ways Beacons Can Enhance the College Campus, Social Retail a digital convergence platform—Connector Technology—Use Cases, retrieved from http://www.digitalsocialretail.com/welcome-to-beacon-u-3-ways-beacons-can-enhance-the-college-campus/ on Jan. 8, 2018.

Baraparte, Ankit S., Vishal k Shelake, Gurudev Y. Pawar, and D.R. Anekar, Smart College System using IoT BLE Beacons, International Journal of Advanced Research in Computer and Communication Engineering, vol. 6, Issue 4, pp. 438-442, Apr. 2017.

European Search Report for Application No. 18210781.3 dated Jan. 23, 2019.

* cited by examiner

AUTOMATED ATTENDEE MONITORING AND GUIDANCE SYSTEM

TECHNICAL FIELD

The present disclosure relates generally to attendance and admittance monitoring systems, and in one particular example to a system for alerting attendees to a location of a room, automatically guiding attendees to the room and automatically monitoring the attendance of the attendees throughout a session.

CROSS-REFERENCE TO RELATED APPLICATION

This application claims priority to Indian Patent Application No. 201711044105 filed on Dec. 8, 2017 and is incorporated herein.

BACKGROUND

Universities and/or job training schools often use attendance in class as one metric for monitoring and ensuring student progress. However, existing systems for monitoring attendance require the utilization of class time to determine which attendees are present. Additionally, when attendance is taken at the beginning of a session the attendance check can fail to account for attendees exiting the classroom early. Similarly, when attendance is taken at the end of a session, the attendance check can fail to account for attendees who arrive late, or who enter the session part-way through.

Further complicating attendance monitoring is the requirement that some classes, such as engineering and technical work classes, can utilize two or more distinct classrooms, labs, and learning areas depending on the subject matter being addressed on a particular day. In such a case, student attendance can be varied, stuttered based on schedules, and the like.

SUMMARY OF THE INVENTION

An exemplary method for monitoring a location of a group of individuals includes receiving a first signal at a server, the first signal including an individual identification (ID) corresponding to a specific individual, and at least one beacon ID corresponding to a unique beacon from a set of beacons, cross-checking the individual ID and the at least one beacon ID with an allowed individuals list, and unlocking an entry-way corresponding to a unique beacon ID in the at least one beacon ID in response to the unique beacon ID corresponding to an entry-way beacon at a room which the individual ID is authorized to access, and cross-checking the individual ID and the at least one beacon ID with an attendance list, and updating an attendance monitoring file on said server in response to the unique beacon ID in the at least one beacon ID corresponding to an interior room beacon.

In one exemplary embodiment a system for monitoring attendance of a group of attendees includes a plurality of beacons distributed throughout a campus, each of said beacons having a unique beacon identification, a plurality of mobile devices, each of said mobile devices corresponding to a single attendee and having a unique attendee identification, a network, and a central server in communication with each of said mobile devices via said network.

These and other features of the present invention can be best understood from the following specification and drawings, the following of which is a brief description.

DETAILED DESCRIPTION OF AN EMBODIMENT

Figure 1:
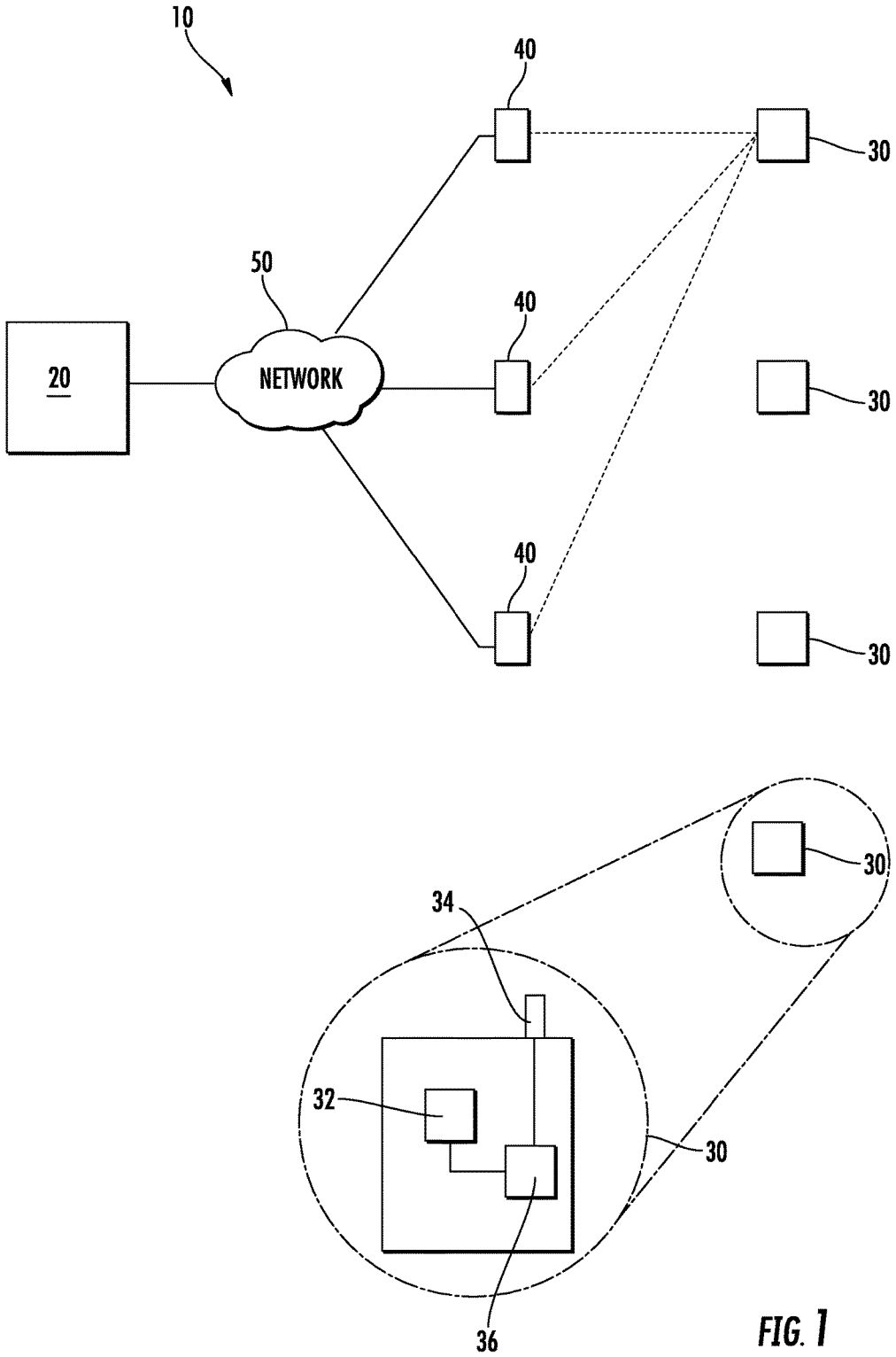
FIG. 1 illustrates a high level schematic attendance monitoring system.

FIG. 1 schematically illustrates an attendance monitoring system 10 including a server 20, and a set of unique beacons 30. The beacons 30 are positioned throughout a campus, such as a school building, and each include a memory 32, and a transmitter 34. In the illustrated example, the beacons 30 further include a processor 36 capable of basic computer processing. Alternatively, some attendance monitoring systems can omit the processor 36. Each of the beacons 30 transmits a unique beacon identifier, such as a numeric code, using the transmitter 34, via a low range local wireless signal. By way of example, the low range local wireless signal can be a Bluetooth protocol signal. Alternative low range wireless protocols could be used to similar effect. The limited range of the low power transmission defines a transmission zone of the beacon 30. Further, in order to prevent beacon tampering in some implementations, each of the beacons 30 can also be connected to the server 20 via the network 50.

Each individual attendee interacts with the system 10 via a mobile device 40, such as a cell phone, tablet, or a dedicated monitoring device. Each mobile device is also assigned a unique identifier. When an attendee enters the broadcast zone of any given beacon 30, their mobile device 40 reads the transmission from the beacon 30. The mobile device 40 then transmits a unique mobile device identifier, and the unique beacon identifier to the server 20 over a network 50 such as the internet. In alternative examples, any other computer network can be utilized to the same effect. Utilizing the combination of unique mobile device and beacon identifiers, the server 20 can determine that a specific attendee is within a broadcast zone of a specific beacon 30, and appropriate corresponding action can be taken by the server 20. In alternate examples, each attendee is assigned a unique identifier, instead of the mobile device 40, and any given attendee can sign in to any given mobile device.

In one example, described in more detail below with regards to FIG. 2, a beacon 30 can be positioned proximate to an entry-way, such as a door. When a mobile device 40 transmits to the server 20 that the mobile device 40 is in a transmission zone of the beacon 30, the server 20 can determine if the owner of the mobile device 40 is authorized to pass through the entry-way and, if so, the server 20 can unlock the door for the authorized user.

In some example systems 10, the mobile device 40 can be a dedicated monitoring device that is specifically constructed to be utilized in, and integrated with, the system 10. In alternative examples, the mobile device 40 can be an attendee's mobile device, such as a cell phone, tablet, smart watch or any similar wearable gadget. In either example, the mobile device 40 includes a specifically designed attendance monitoring module that configures the mobile device 40 to receive the short range transmissions from the beacons 30 when the mobile device 40 is within range of the beacon 30, and to transmit a signal to the server 20 using the network 50.

Further, in some examples the beacons 30 can be oriented, or targeted, such that the short range transmission zone is prevented from extending certain directions from the beacon 30. By way of example, a beacon 30 can be positioned at an entry-way and oriented such that only attendees in the hallway, passing by, approaching, or exiting the entry-way interact with the transmission. Such an example can be utilized in conjunction with a secondary attendance beacon within a room as described below. The specific range and transmission zone of any given beacon 30 can be controlled via adjusting a power level of the beacon 30, partially shielding a transmission antennae of the beacon 30, a physical orientation of the beacon 30, or any similar technique for controlling wireless transmissions.

With continued reference to the system 10 described above in FIG. 1, FIG. 2 schematically illustrates a partial implementation of the system 10 within a single room 100. The room 100 includes a single entry-way 110. An entry beacon 120 is disposed at the entry-way 110 and generates a broadcast zone 112 at the entry-way 110. In order to prevent unauthorized attendees from entering the room 100, a door is maintained in a locked state at the entry-way 110.

When a user 130 approaches the entry-way 110 and enters the broadcast zone 112, a mobile device 140 carried by the user 130 interacts with the entry-way beacon 120 and receives the transmitted unique beacon ID corresponding to the entry-way beacon 120. The mobile device 140 then transmits a unique mobile device ID, or a unique user ID. and the received unique beacon ID to the server 20 (illustrated in FIG. 1), and the server 20 determines whether the user 130 is authorized to enter the room 100 or not. If the user 130 is authorized to enter the room 100, the server 20 interacts with building security systems and unlocks the door at the entry-way 110 for a pre-determined period of time sufficient to allow the user 130 to enter the room 100.

The broadcast zone 112 of the short range transmission from the entry-way beacon 120 is oriented away from the room 100, and into the adjoining hallway. In this way, a user 130 carrying a mobile device 140 outside of the room 100 interacts with the beacon 120, while the same user 130 within the room would not interact with the beacon 120. In some examples, the wall defining the room and/or features of the entry-way 110 can further shield a user 130 within the room from interacting with the broadcast zone 112 of the entry-way beacon 120.

A second user 150 is illustrated having already entered the room 100 through the entry-way 110. The second user 150 has a second mobile device 160 that interacts with an attendance monitoring beacon 170 disposed within the room 100. As with the interaction between the mobile device 140 and the entry-way beacon 120, the second mobile device 160 receives a unique beacon ID corresponding to the attendance monitoring beacon 170. The second mobile device 160 then transmits a combination of the unique mobile device ID and the unique beacon ID to the server 20. Based on this transmission, the server 20 can determine that the user 150 is attending an event, such as a class, in the room 100.

In some examples, the second mobile device 160 transmits a combination of the unique user ID, the attendance monitoring beacon 170, and the most recent entry-way beacon 120. Such a transmission provides additional detail to the server 20 and can ensure that an attendee is not spoofing the unique beacon ID of the attendance monitoring beacon 170, by allowing the server 20 to verify that the most recently passed entry-way beacon 120 is an entry-way to the room 100 containing the attendance monitoring beacon 170.

In some further examples, the second mobile device 160 can continuously transmit the combination of the mobile device ID and the two beacon IDs for a duration of a class, thereby allowing the server 20 to monitor the attendance of the user 150 for a full duration of a class or other event. The continuous transmission example can be applied to the single beacon ID implementation to achieve a similar result.

In further examples a professor 180 can interact with the server 20 using a third mobile device 190. In such an example, the professor 180 is given unique and elevated privileges through a software module installed on the third mobile device 190. The software module allows the professor 180 to query the server to determine how many attendees are present, which attendees are present, the most recently scanned beacon of any non-present scheduled attendees, or any similar information. In some further implementations, the software module can be configured to allow the professor to update or alter a location of the class and a time of the class. In such implementations, the updated information is transmitted to attendees via the mobile devices 140, 160. In yet further implementations, the software module can be configured to allow any user with the level of the professor to monitor attendance of a class, location of attendees, or update or alter class locations, times, and the like.

In yet further examples, a single room 100 including multiple entry-ways 110 can be implemented. In such an example, each of the entry-ways 110 includes a corresponding entry-way beacon 120 with its own unique beacon identifier.

Figure 2:
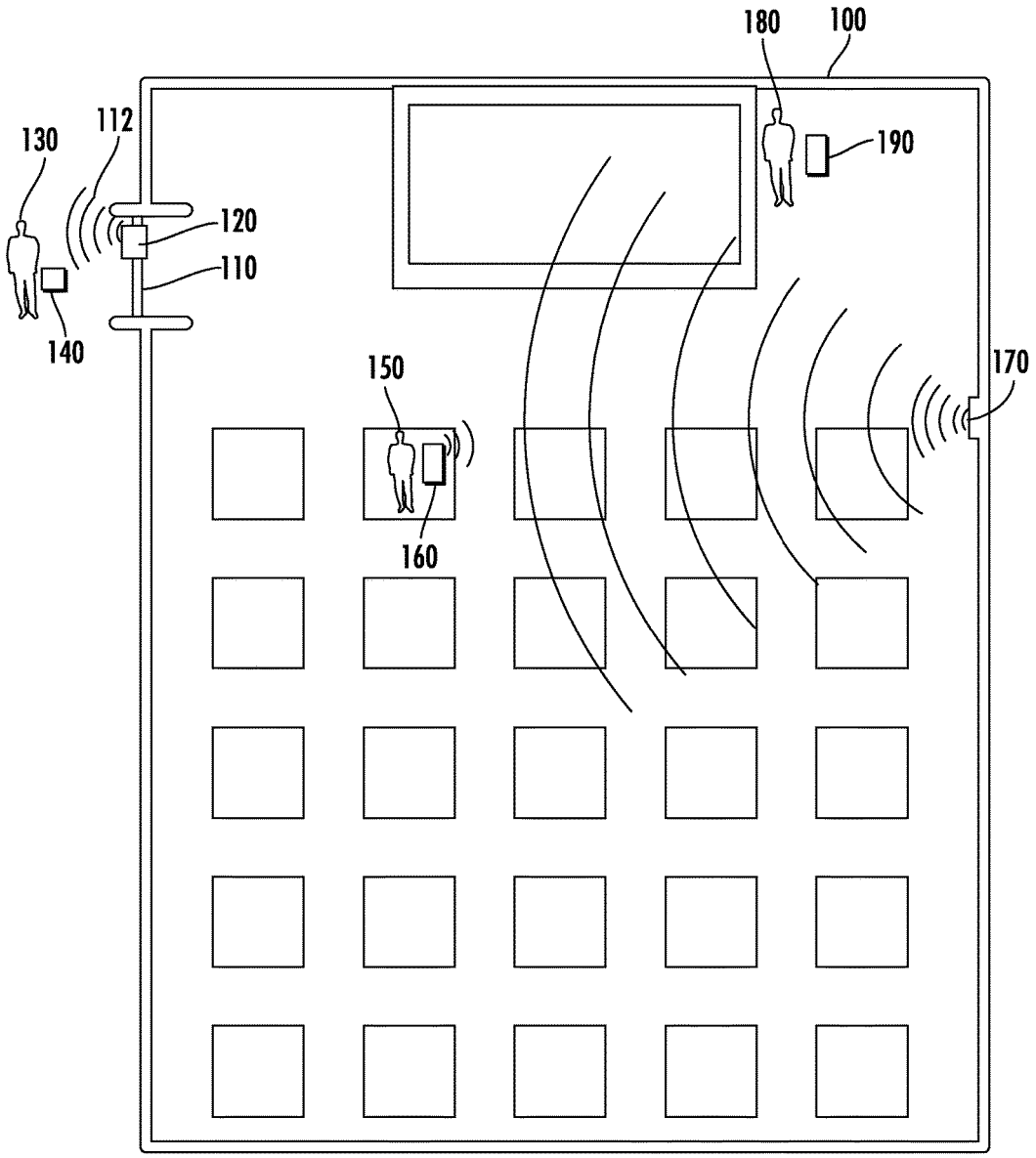
FIG. 2 illustrates an implementation of an attendance monitoring system in a single room.
Figure 3:
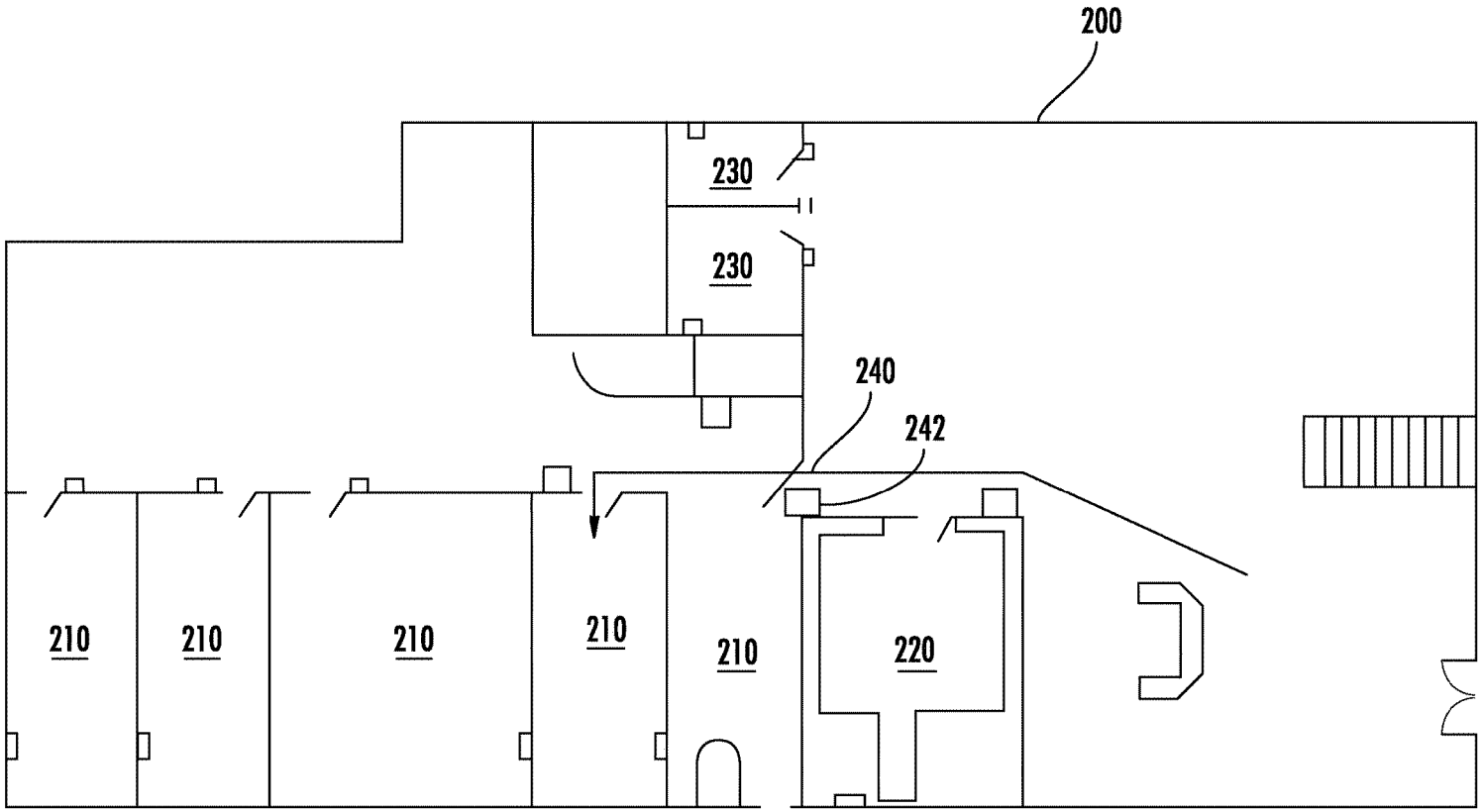
FIG. 3 illustrates an exemplary single building campus incorporating an attendance monitoring system.
Figure 4:
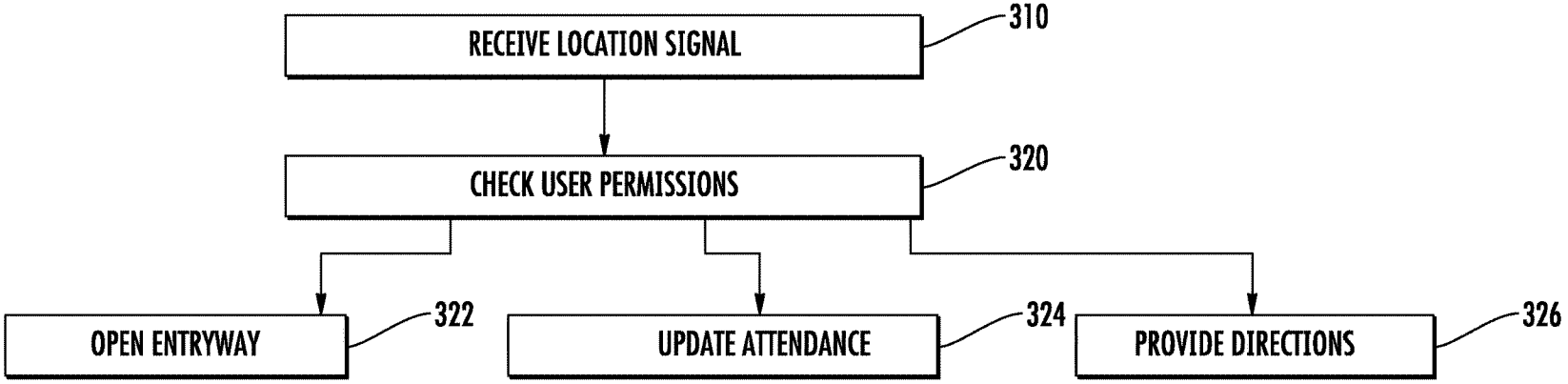
FIG. 4 illustrate a flowchart of a process for monitoring attendance.

With continued reference to the examples of FIGS. 1 and 2, it can be appreciated that the system 10 can be expanded to multiple rooms throughout a given campus, such as a single school building, or multiple buildings at a university campus, to achieve additional benefits. FIG. 3 schematically illustrates campus 200, such as a single floor of a building, exemplifying this configuration. The campus 200 includes multiple classrooms 210, as well as a conference room 220, and multiple labs 230.

Each of the classrooms 210, the conference room 220, and the multiple labs 230 includes the entry-way beacon 120, and attendance beacon 170 configuration described above with regards to FIG. 2. Further, the beacons are configured such that a transmission zone of each entry-way beacon extends only into the adjoining hallway, thereby preventing interference with the corresponding attendance beacons.

In certain instances, an attendee may not know which classroom 210, conference room 220 or lab 230 they are supposed to attend on any given day. In order to assist the attendee, the attendance monitoring module stored on each of the mobile devices can include a direction and scheduling feature. When the user accesses the direction and scheduling feature, the mobile device can query the server to determine which classroom 210, 220, 230 the attendee is supposed to be attending, and at what time.

In yet further examples, the direction and scheduling feature can identify where the attendee is within the campus by determining the nearest beacon to the attendee. Once the location of the attendee is determined by the server, the server can provide the direction and scheduling feature with directions to the location where the attendee should be, and the mobile device can display those directions. In yet further examples, any other directional indicator including audio cues and vibrational cues can be used to indicate the direction as well.

In some instances, an attendee may wish to disable the capability of the direction and scheduling feature to monitor their location on the campus. Ordinarily, this could be achieved by the attendee placing their mobile device in airplane mode, disabling Wi-Fi communication, or both. In order to prevent this, the direction and scheduling feature is, in some examples, configured to re-enable data and Wi-Fi capabilities of the mobile device if the attendee disables them. In some examples, the re-enabling can be limited to a duration sufficient to transmit the attendee's location to the server. In other examples, the duration can be unlimited in scope. In yet further examples, disabling the communications of the mobile device will provide a notification from the server to a professor, or other monitor, that the attendee has disabled, or attempted to disable, their mobile device. In addition, some example systems can display on their mobile device that a professor, or other monitor, has received this notification.

In some examples, the classrooms 210 can be gated from the remainder of the campus 200 via another entry-way 240. In such an example, an additional beacon 242 is positioned at the entry-way 240, and operates in a similar fashion to the previously described beacons. In yet further implementations, the campus can be configured such that a local transmission zone of each beacon does not intersect with a local transmission zone of any other beacons.

With continued reference to the examples illustrated above in FIG. 1-3, FIG. 4 illustrates a flowchart demonstrating the method for monitoring the attendance of an individual as enacted by the server 20. Initially, the server 20 receives a signal over the network 50 from one of the mobile devices 40 in a "receive location signal" step 310. The signal includes a combination of an individual identification corresponding to the specific individual and a beacon identification corresponding to a beacon that the individual has entered the transmission zone of. By way of example, the individual identification can be a mobile device ID, when the individual has their own dedicated mobile device, or it can be a user ID, when the user is logged into an attendance monitoring module on the mobile device 40. Further, as described above, in some examples the signal can include a combination of multiple beacon identifications.

The server 20 then cross checks the individual ID and the beacon ID with a permissions list in a "check user permissions" step 320. In the case that the beacon ID corresponds to a specific entry-way, such as a lab entry-way, the server 20 will determine if the individual is authorized to pass through the entry-way based on the permissions. If the user is authorized, the server 20 will interface with building security systems and unlock the entry-way for a predetermined period of time sufficient for the individual to pass through in an "open entry-way" step 322.

Alternatively, when the beacon ID corresponds to an attendance beacon within any given room, the server 20 will determine from the permissions list that the individual corresponding to the individual ID is an attendee of the event occurring within the room, and will update an attendance sheet within the server 20 in an "update attendance" step 324.

In the case that the user corresponding to the individual identification is not authorized to pass through an entry-way and/or is not scheduled to attend an even in the corresponding room, the server 20 can determine, based on the user permissions where the user is next scheduled to be. The server 20 can then transmit directions to the next location from the users current location to the user's mobile device 40 in a "provide directions" step 326.

While described above in the context of schools, and classes, one skilled in the art will appreciate that the idea can be extended to any institutional attendance monitoring and is not limited to schools.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A method for monitoring a location of a group of individuals comprising:

receiving a first signal at a server, the first signal including an individual identification (ID) corresponding to a specific individual, and at least one beacon ID corresponding to a unique beacon from a set of beacons;

cross-checking the individual ID and the at least one beacon ID with an allowed individuals list, and unlocking an automated lock on an entry-way corresponding to a unique beacon ID in the at least one beacon ID in response to the unique beacon ID corresponding to an entry-way beacon at a room which the individual ID is authorized to access, wherein the automated lock is part of a campus security system in communication with the server; and cross-checking the individual ID and the at least one beacon ID with an attendance list, and updating an attendance monitoring file on said server in response to the unique beacon ID in the at least one beacon ID corresponding to an interior room beacon.

2. The method of claim 1, further comprising transmitting a second signal from the server to a mobile device in response to the unique beacon ID in the at least one beacon ID being an entry-way beacon at a room which the individual ID is not authorized to access.

3. The method of claim 2, wherein the second signal includes directions configured to cause a receiving mobile device to display directions to the room which the individual ID is authorized to access.

4. The method of claim 1, further comprising determining a position of the specific individual on a campus based at least in part on a position of the received at least one beacon ID.

5. The method of claim 4, wherein the campus is a single building.

6. The method of claim 4, wherein the campus is a multi-building campus.

7. The method of claim 1, wherein each beacon in said set of beacons transmits a local signal including the corresponding beacon ID.

8. The method of claim 7, wherein the at least one beacon ID in the first signal includes a beacon ID corresponding to a beacon in said set of beacons that is in closest physical proximity to the specific individual.

9. The method of claim 1, further comprising the server receiving a third signal from an authorized user, and updating at least one entry-way that at least one specific user is authorized to access.

10. The method of claim 1, wherein the at least one beacon ID comprises a first unique beacon ID corresponding to a most recently passed entry-way beacon and a second unique beacon ID corresponding to an attendance monitoring beacon.

11. A system for monitoring attendance of a group of attendees comprising:

a plurality of beacons distributed throughout a campus, each of said beacons having a unique beacon identification;

a plurality of mobile devices, each of said mobile devices corresponding to a single attendee and having a unique attendee identification;

a network; and a central server in communication with each of said mobile devices via said network; and a campus security system in communication with the server, the campus security system including at least one automated lock.

12. The system of claim 11, wherein each of said beacons defines a local transmission zone.

13. The system of claim 12, wherein the local transmission zone is a region in which the beacon transmits a local transmission including the unique beacon identification of the beacon defining the transmission zone.

14. The system of claim 13, wherein none of the local transmission zones intersects another of the local transmission zones.

15. The system of claim 11, wherein each of the mobile devices includes a processor and a memory, the memory storing a direction and scheduling feature configured to cause the mobile device to display directions in response to a signal from the server.

16. The system of claim 11, wherein the plurality of beacons includes a subset of entry-way beacons and a subset of attendance beacons.

17. The system of claim 11, wherein the automated lock is a lock on a door corresponding to an entry-way beacon in said plurality of beacons.

18. The system of claim 11, wherein each of said beacons in said plurality of beacons is in communication with the server via the network.

19. The system of claim 11, wherein each of said beacons comprises a transmitter and a memory, and wherein the memory stores the unique beacon identifier and instructions for causing the transmitter to transmit the unique beacon identifier.

* * * * *